US011124015B2

(12) United States Patent
Reuther et al.

(10) Patent No.: US 11,124,015 B2
(45) Date of Patent: Sep. 21, 2021

(54) METHOD FOR PRODUCING A DECAL, AND A DECAL AND A DEVICE FOR PRODUCING A DECAL, AND METHOD FOR DECORATING SURFACES OF OBJECTS

(71) Applicant: LEONHARD KURZ Stiftung & Co. KG, Fürth (DE)

(72) Inventors: Uwe Reuther, Nuremberg (DE); Oliver Jankewitz, Anhui (CN)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 0 days.

(21) Appl. No.: 16/489,906

(22) PCT Filed: Feb. 14, 2018

(86) PCT No.: PCT/EP2018/053698
§ 371 (c)(1),
(2) Date: Aug. 29, 2019

(87) PCT Pub. No.: WO2018/162196
PCT Pub. Date: Sep. 13, 2018

(65) Prior Publication Data

US 2020/0001647 A1 Jan. 2, 2020

(30) Foreign Application Priority Data

Mar. 6, 2017 (DE) ..... 10 2017 104 658.5

(51) Int. Cl.
*B44C 1/175* (2006.01)
*B41J 2/005* (2006.01)
*B41M 3/12* (2006.01)

(52) U.S. Cl.
CPC ..... *B44C 1/1758* (2013.01); *B41J 2/0057* (2013.01); *B41M 3/12* (2013.01); *B44C 1/1756* (2013.01)

(58) Field of Classification Search
CPC .... B41J 2/0057; B44C 1/1758; B44C 1/1756; B41M 3/12
See application file for complete search history.

(56) References Cited

U.S. PATENT DOCUMENTS 2,305,553 A 12/1942 Orswell
2,625,496 A 1/1953 Swift et al.
(Continued)

FOREIGN PATENT DOCUMENTS

CN 1356214 A 7/2002
CN 101695891 A 4/2010
(Continued)

OTHER PUBLICATIONS

Incoming Written Opinion of the ISA PCT/EP2018/053698—English Translation, dated Aug. 29, 2018.*
(Continued)

*Primary Examiner* — Sharon Polk
(74) *Attorney, Agent, or Firm* — Hoffmann & Baron, LLP

(57) ABSTRACT

A method for producing a decal with at least one decoration includes:
providing a transfer paper,
printing, by means of inkjet printing, a primer onto the transfer paper and/or onto a stamping film having a carrier ply and a decorative ply, and
applying, at least in areas, the stamping film to the transfer paper by means of hot or cold stamping.
A decal includes a transfer paper and a decoration that can be separated from the transfer paper, wherein the decoration has a primer printed by means of inkjet, a decorative ply of a stamping film and optionally an ink and/or ink layer printed by means of inkjet and/or a protective varnish printed by means of inkjet.
(Continued)

A device for producing a decal and a method for decorating surfaces of object, in particular three-dimensional objects.

13 Claims, 3 Drawing Sheets

(56) References Cited

U.S. PATENT DOCUMENTS

| | | | | |
|---|---|---|---|---|
| 3,463,651 | A * | 8/1969 | Warsager | B44C 1/1716 428/138 |
| 4,012,552 | A | 3/1977 | Watts | |
| 5,595,810 | A | 1/1997 | Beinert et al. | |
| 2006/0246266 | A1 | 11/2006 | Hall | |
| 2010/0000668 | A1 | 1/2010 | Wu et al. | |
| 2015/0090582 | A1 | 4/2015 | Chen et al. | |
| 2018/0072045 | A1 | 3/2018 | Kosalla et al. | |
| 2018/0215190 | A1 | 8/2018 | Reuther | |

FOREIGN PATENT DOCUMENTS

| | | | | |
|---|---|---|---|---|
| CN | 102825938 | A | 12/2012 | |
| DE | 4311200 | A1 | 10/1994 | |
| DE | 102015104321 | A1 | 9/2016 | |
| EP | 0057940 | A2 | 8/1982 | |
| EP | 0661177 | A1 | 7/1995 | |
| EP | 2105319 | A1 | 9/2009 | |
| WO | 8403473 | | 9/1984 | |
| WO | WO-0002739 | A1 * | 1/2000 | C09J 11/00 |
| WO | 2017021461 | A1 | 2/2017 | |

OTHER PUBLICATIONS

Examination Report dated Nov. 11, 2017.
International Search Report dated Aug. 29, 2018.

* cited by examiner

METHOD FOR PRODUCING A DECAL, AND A DECAL AND A DEVICE FOR PRODUCING A DECAL, AND METHOD FOR DECORATING SURFACES OF OBJECTS

This application claims priority based on an International Application filed under the Patent Cooperation Treaty, PCT/EP2018/053698, filed Feb. 14, 2018, which claims priority to DE 102017104658.5, filed Mar. 6, 2017.

BACKGROUND OF THE INVENTION

The invention relates to a method for producing a decal, and a decal as well as a device for producing a decal, and a method for decorating surfaces of objects.

A variety of methods are known for the decoration of three-dimensional objects. Thus, for example, the waterslide method is known. Here the different layers of a decoration are printed onto a transfer paper by means of screen printing. A disadvantage here is that a specially manufactured screen printing stencil is needed, and thus has to be manufactured, for each print. The method is therefore not efficient for utilization in individual use, where only a few identical decorations are needed, due to the plurality of screen printing stencils necessary. Because, in this method, there is additionally the need for individual layers of the decoration to be dried for several hours first, before further layers can be applied, the method is furthermore time-consuming and thus expensive.

SUMMARY OF THE INVENTION

An object of the present invention is thus to specify an improved method by which the named disadvantages are reduced or avoided.

The object is achieved by a method for producing a decal with at least one decoration, comprising the steps of:

providing a transfer paper, printing, by means of inkjet printing, a primer onto the transfer paper and/or onto a stamping film having a carrier ply and a decorative ply, applying, at least in areas, the stamping film to the transfer paper by means of hot or cold stamping.

The method steps are preferably effected in the specified sequence.

The object is further achieved by a decal, in particular which can be obtained by a method according to the invention, comprising a transfer paper and a decoration which can be separated from the transfer paper, wherein the decoration has a primer printed by means of inkjet, a decorative ply of a stamping film and optionally an ink and/or ink layer printed by means of inkjet and/or a protective varnish printed by means of inkjet.

Furthermore, the object is achieved by a device for producing a decal having a transfer paper and at least one decoration, comprising:

at least a first inkjet printhead for printing a primer onto the transfer paper and/or onto a stamping film having a decorative ply and a carrier ply, and a stamping station, for applying the stamping film to the transfer paper, arranged downstream of the first inkjet printhead in the conveying direction of the transfer paper.

In addition, the object is achieved by a method for decorating surfaces of objects, in particular three-dimensional objects, comprising the steps of:

providing a decal, in particular a decal according to the invention, with a transfer paper and at least one decoration, soaking the decal, in particular in water, and/or bringing the decal into contact with a pad, and applying the decoration to the object.

Through the invention, decals can be manufactured in particular quickly, inline and without tool generation. Because the generation of screen printing stencils is dispensed with in the present case, the method is also suitable for small quantities, in particular a quantity of one. The desired embodiments or designs of the decal can be generated electronically by means of corresponding software on a computer, then they are converted into corresponding electronic printing commands and then printed onto the transfer paper and/or the stamping film in the desired shape or design.

Through the present invention, overall a simple, reliable and quick, in particular an efficient, production method is created which can be used both in the manufacture of mass-produced goods and for individually manufactured decals. This is achieved in particular by digital inkjet printing.

By decal is meant in the present case in particular transfer pictures, having a carrier material and in particular at least one decoration which can be detached from the carrier material. The decoration can have a motif. A motif can be, for example, a graphically designed outline, a figurative representation, a picture, a visually recognizable design element, a symbol, a logo, a portrait, a pattern, an alphanumeric character, text, a colored design and the like. A water-soluble layer and/or a hot-melt coating is in particular arranged between carrier material and motif. In particular, the term decal also covers waterslide decals.

Within the meaning of the invention, by transfer paper is meant in particular a paper or generally a substrate, preferably made of plastic and/or of a substance which is coated with a water-soluble layer such as for example dextrose, methylcellulose and/or polyvinyl alcohol and/or which is coated with a hot-melt coating comprising for example wax and/or thermoplastic polymers. In particular if the transfer paper has a water-soluble layer, the transfer paper is thus preferably a water transfer paper. In particular if the transfer paper has a hot-melt coating, the transfer paper is preferably a heat transfer paper. The transfer paper can be provided both in rolls and as sheets.

A water transfer paper and/or a heat transfer paper is preferably provided as transfer paper. It is thus possible for the transfer paper to be a water transfer paper and/or a heat transfer paper.

The transfer paper is preferably peeled off before the decoration is applied to the object to be decorated.

By decoration is meant in particular those layers or the plies of the decal which are transferred onto the object to be decorated at a later time. The decal can have the primer and at least a part of the stamping film, in particular at least a part of the decorative ply. If yet further layers are applied to and/or printed onto the stamping film and/or the decorative ply of the stamping film or the primer during the production of the decal, then these layers also in principle represent parts of the decoration.

By a stamping film is meant in particular transfer films which have a self-supporting carrier film, on which a decorative ply which can be detached from the carrier film is arranged. The decorative ply can be transferred or conveyed onto a substrate. The decorative ply can have several whole-surface and/or partial layers.

The surfaces of the objects are in principle not set to a specific shape. The surfaces can be shaped cylindrical, wavy, pyramidal, conical, curved, concave and/or convex. They can also be formed angular, in particular rectangular or generally polygonal, oval, round and/or flat.

The objects can be objects made of glass, ceramic, porcelain, plastic, wood and/or paper and/or metal and/or composites of several different materials, for example plastic/glass, plastic/metal, plastic/wood, plastic/paper. It can be advantageous to pretreat the surface of the objects, for example by means of plasma or corona treatment and/or by means of precoating with adhesion-promoter layer, for example with one or more polymeric adhesion-promoter layers.

The decorative ply of the stamping film can be formed single- or multi-layered. The carrier ply of the stamping film is preferably formed from PET, PC, PP, PE, PVE and/or PS. The carrier ply protects and stabilizes the decorative ply in particular during the production, storage and processing of the stamping film.

The decorative ply is in particular detachable from the carrier ply. In order to be able to ensure a reliable detachment between carrier ply and decorative ply, the stamping film can have a detachment layer between the carrier ply and the decorative ply. The detachment layer is preferably formed such that it on the one hand guarantees a safe handling of the stamping film, without the decorative ply separating from the carrier ply before the stamping film is applied to the transfer paper, but on the other hand makes it possible to detach, at least in areas, the decorative ply from the carrier ply after the stamping film has been applied or when the decorative ply is transferred onto the transfer paper.

The detachment layer preferably has a layer thickness of from 0.001 μm to 1 μm, in particular a layer thickness of from 0.001 μm to 0.1 μm, particularly preferably a layer thickness of approx. 0.01 μm. The detachment layer can comprise waxes and/or silicones. It is advantageously a polymeric detachment layer. The detachment layer is particularly preferably free of wax and/or free of silicone. A layer which can be overprinted very well, in particular with conventional printing inks, with UV-curing printing inks, UV-curing varnishes, hybrid inks and/or hybrid varnishes (UV=ultraviolet, ultraviolet radiation), is hereby obtained. A good adhesion between decorative ply and print and/or printing inks can also be achieved in this way.

The detachment layer advantageously comprises hydroxypropyl methylcellulose, in particular 90 wt.-% to approx. 100% hydroxypropyl methylcellulose (wt.–%=percent by weight).

The decorative ply advantageously has at least one metallic layer. The metallic layer ensures in particular the visual appearance of the decorative ply and/or of the decoration. The metallic layer preferably comprises aluminum or consists of aluminum. However, it is also possible for the metallic layer to be formed from copper, chromium and/or tin or to comprise an alloy thereof. The metallic layer preferably has a layer thickness of from 5 nm to 100 nm, in particular a layer thickness of from 5 nm to 50 nm, particularly preferably a layer thickness of from 15 nm to 25 nm, wherein the metallic layer is preferably vapor-deposited by means of known PVD or CVD methods (PVD=Physical Vapor Deposition; CVD=Chemical Vapor Deposition). The metallic layer, in particular consisting of inks with metallic, in particular with fine metallic, pigments, can additionally or alternatively also be printed on. The metallic layer can be over the whole surface or can be present only partially. A partial metallic layer can be structured in particular by means of known demetallization methods such as etching, washing methods or photolithographic methods.

The decorative ply preferably has at least one ink layer. The ink layer is preferably printed on by means of gravure printing, screen printing, flexographic printing and/or inkjet printing, and preferably has a layer thickness of from 0.2 μm to 10 μm, in particular a layer thickness of from 0.5 μm to 3 μm. The ink layer can be present over the whole surface and/or partially. The ink layer can be opaque or translucent or transparent and in each case can be colorless or colored. The chromaticity can be achieved by means of dyes and/or pigments in the ink layer. For example, the ink layer consists of polyacrylates.

It is in particular also possible to provide the ink layer and the metallic layer in each case partially and to arrange the partially provided areas in register with each other. For example, the metallic layer and/or the ink layer, individually or together, represent a motif or in each case a motif or partial motif.

By register or registration, register accuracy or registration accuracy, is meant a positional accuracy of two or more elements and/or layers relative to each other. The register accuracy is to vary within a predefined tolerance, which is to be as small as possible. At the same time the register accuracy of several elements and/or layers relative to each other is an important feature in order to increase the process reliability. The positionally accurate positioning can be effected in particular by means of sensory, preferably optically detectable, registration marks or register marks. These registration marks or register marks can represent either special separate elements or areas or layers, or themselves be part of the elements or areas or layers to be positioned.

The decorative ply preferably has a basecoat. The basecoat ensures in particular a good adhesion between the decorative ply or the stamping film and the primer. The basecoat preferably has a layer thickness of from 0.2 μm to 10 μm, in particular a layer thickness of from 0.5 μm to 3 μm, particularly preferably a layer thickness of from 0.4 μm to 0.6 μm.

Basecoat layers which have the following composition have proved to be advantageous:

| | |
|---|---|
| polyvinyl butyral | 25% to 50% |
| styrene maleic anhydride | 50% to 75% |

In particular, a sharp-edged stamping can be achieved through the use of styrene maleic anhydride. Furthermore, possible crosslinking reactions with the primer can hereby also be catalyzed, i.e. made possible and/or improved.

The decorative ply can preferably comprise at least one varnish layer, in particular a protective varnish layer. The protective varnish layer represents in particular a protection from mechanical and/or chemical stress for the decorative ply and/or the decoration on an object to be decorated. The varnish layer and/or protective varnish layer preferably has a layer thickness of from 0.4 μm to 10 μm, in particular a layer thickness of from 0.5 μm to 5 μm, in particular preferably a layer thickness of from 1 μm to 1.5 μm. The varnish layer and/or the protective vanish layer advantageously has/have an isocyanate crosslinking. In particular, higher scratch, wear and chemical resistances can be achieved hereby. If the varnish layer or the protective varnish layer contains dyes, the layer can influence the optical impression of the decorative ply.

Varnish and/or the protective varnish layers which have the following composition have proved to be advantageous:

| | |
|---|---|
| acrylate polyol | 36 wt.-% to 56 wt.-%, |
| polyvinyl butyral | 9 wt.-% to 14 wt.-%, |
| diisocyanate | 30 wt.-% to 40 wt.-% |
| dyes | 0 wt.-% to 25 wt.-%. |

At least the varnish layers and/or the protective varnish layers and/or the basecoat, in particular all of these layers, are advantageously provided with polymers containing hydroxyl groups. The layers hereby obtain a sufficiently high tensile strength, with the result that the decorative ply or the decoration applied to the object to be decorated does not experience any cracking and/or blistering during a tempering in a furnace. The inkjet ink applied later and the protective varnish can also be provided with polymers containing hydroxyl groups.

The printed-on primer defines in particular the surface area or the surface areas for the stamping film transfer or for the later decoration. The primer preferably serves here as adhesion promoter or adhesive, to which the decoration adheres. In particular, the adhesion between decoration and primer is greater than the adhesion between decoration and surface areas without primer.

In particular, the primer has only a very small number of solid constituents, such as particulate material and/or particles, which should not exceed a particular size, in particular a size of from 2 μm to 10 μm. It is hereby achieved that the nozzles of the printhead do not clog. The primer is preferably not pigmented. In particular, the primer has no fillers at all.

The primer is advantageously printed on with an area density of from 0.5 g/m$^2$ to 20 g/m$^2$. The printed-on primer preferably has a layer thickness of from 0.05 μm to 10 μm, in particular a layer thickness of from 1 μm to 5 μm. Within this area, which guarantees a particularly good adhesion, the applied quantity and/or the layer thickness of the primer can be varied in order to further optimize the application result, thus in particular the adhesion of the decoration on the primer.

It is furthermore preferred if the primer is printed on at an application temperature of from 20° C. to 75° C., preferably of from 40° C. to 60° C., and/or with a viscosity in the range of from 5 mPas to 100 mPas, preferably of from 10 mPas to 15 mPas. A temperature control of the printhead here in particular ensures that the primer has the desired viscosity. In particular, the pixel size and pixel shape of the applied primer depends on the viscosity, wherein with the specified values an optimum printability of the primer can be guaranteed.

A primer which has the following composition has proved to be advantageous:

| | |
|---|---|
| 4-(1-oxo-2-propenyl)morpholine | 29 wt.-% to 50 wt.-%, |
| exo-1,7,7-trimethylbicyclo[2.2.1]hept-2-yl acrylate | 25 wt.-% to 50 wt.-%, |
| 2-phenoxyethyl acrylate | 25 wt.-% to 50 wt.-%, |
| dipropylene glycol diacrylate | 3 wt.-% to 10 wt.-%, |
| 2,4,6-trimethylbenzoyl diphenylphosphine oxide | 3 wt.-% to 10 wt.-%. |

Such a formulation yields in particular a rapid full cure and a viscosity which makes a good printability possible with at the same time stable and sharp-edged application.

A light-curing, in particular UV-curing, primer is preferably printed on.

By light is meant in the present case in particular not only the part of the electromagnetic radiation visible to the human eye, but in particular also the regions adjacent to visible light, in particular infrared and/or ultraviolet radiation. The physical definition of light, namely that light encompasses the entire electromagnetic spectrum, essentially applies.

The primer can be partially cured or precured and/or fully cured by radiation, preferably by UV radiation, in particular by UV-LED radiation.

The application quality of the primer can be improved by a precure. In particular, the viscosity of the primer is hereby increased before the stamping film is applied. This prevents the applied primer pixels from running or squeezing together too much during the transfer, with the result that a particularly sharp-edged application of the stamping film and a particularly high surface quality of the transferred layers are achieved. However, a slight squeezing together of the primer pixels can be quite desirable in order to bring directly adjacent primer pixels closer to each other and combine them. This can be advantageous in order, for example in the case of closed surface areas and/or at motif edges, to avoid a pixelation of the representation, i.e. to prevent individual pixels from appearing in an optically disruptive manner. The squeezing together should be effected only to the extent that the desired resolution is not reduced too much.

To prevent a squeezing together of an image and/or motif generated by the printed-on primer, the precure of the primer, preferably with a low UV radiation power, is advantageous. The primer is in particular partially gelatinized hereby.

The precure of the primer is preferably effected 0.02 s to 0.025 s after the primer is printed on. The primer is hereby fixed on the transfer paper very quickly after the printing due to the precure, with the result that the primer droplets are largely prevented from running or spreading and a high print resolution is preserved as well as possible. For this, for example, a radiation source can be arranged directly adjacent to the printhead for printing the primer on.

It is expedient here if the precure of the primer is effected by UV radiation, of which preferably at least 90% of the energy is emitted in the wavelength range between 380 nm and 420 nm. At these wavelengths the precure is reliably started.

It is further advantageous if the precure of the primer is effected with a gross irradiance of from 2 W/cm$^2$ to 5 W/cm$^2$ and/or a net irradiance of from 0.7 W/cm$^2$ to 2 W/cm$^2$ and/or an energy input into the primer of from 8 mJ/cm$^2$ to 112 mJ/cm$^2$. It is hereby achieved that the primer undergoes the desired viscosity increase, while not being completely fully cured, with the result that the necessary adhesive effect of the primer is preserved when the stamping film is applied.

The precure of the primer is preferably effected with an exposure time of from 0.02 s to 0.056 s. The necessary energy input for the precure is thus ensured at the mentioned transport speeds of the transfer paper and at the specified irradiances.

It is expedient if, during the precure of the primer, its viscosity increases to 50 mPas to 200 mPas. Such a viscosity increase can mean that the primer droplets are squeezed together during the application of the stamping film to the transfer paper, with the result that the stamping film can be transferred onto the transfer paper substantially with the resolution achieved during the printing of the primer.

The full cure of the primer is preferably effected after the stamping film has been applied. It is expedient here if the full cure of the primer is effected with UV light, of which preferably at least 90% of the energy is emitted in the wavelength range between 380 nm and 420 nm. At these wavelengths the full cure is reliably started.

Furthermore, it is preferred if the full cure of the primer is effected with a gross irradiance of from 12 W/cm$^2$ to 20 W/cm$^2$ and/or a net irradiance of from 4.8 W/cm$^2$ to 8 W/cm$^2$ and/or an energy input into the primer of from 200 mJ/cm$^2$ to 900 mJ/cm$^2$, preferably of from 200 mJ/cm$^2$ to 400 mJ/cm$^2$. A reliable through cure of the primer is achieved with such an energy input.

Furthermore, it is advantageous if the full cure of the primer is effected with an exposure time of from 0.04 s to 0.112 s. The necessary net energy input for the through cure of the primer is thus ensured at the specified gross irradiances and at the usual transport speeds.

It is advantageous if the full cure of the primer takes place together with the full cure of further layers, which have additionally also been printed onto the transfer paper. The entire decoration is hereby fully cured in only one step, which makes the method very efficient.

The primer is preferably dried after being printed on, preferably dried by means of IR radiation (IR=infrared). The duration here is preferably between 1 s and 60 s and/or the temperature lies between 40° C. and 120° C.

The stamping film is preferably applied in a roll-on method. For this, the stamping station has at least one stamping roller and/or a stamping wheel and/or a curved stamping punch.

In a further step at least one ink and/or at least one ink layer is preferably printed on by means of inkjet printing. The ink and/or the ink layer are in particular printed onto the stamping film or on the decorative ply. The ink and/or the ink layer forms/form in particular a part of the decoration and thus also determines/determine the visual appearance of the decoration. In particular, the ink and/or the ink layer can be applied in register with a feature of the stamping film. The feature can be a register mark and/or a motif on the stamping film.

A light-curing, in particular a UV-curing, particularly preferably an LED-curing, in particular preferably a UV-LED-curing, ink and/or ink layer is/are preferably printed on.

The ink and/or the ink layer can be partially cured or precured and/or fully cured by radiation, preferably by UV radiation, in particular by UV-LED radiation. In particular, the partial and/or full cure of the ink and/or the ink layer is effected analogously to or under the same conditions as in the case of the primer described in the present case.

The layer thickness of the ink and/or the ink layer preferably lies between 0.5 μm and 10 μm, in particular between 0.5 μm and 5 μm.

Inks and/or ink layers which have the following composition have proved to be advantageous:

| | |
|---|---|
| 2-phenoxyethyl acrylate | 25 wt.-% to 50 wt.-%, |
| 4-(1-oxo-2-propenyl)morpholine | 10 wt.-% to 25 wt.-%, |
| exo-1,7,7-trimethylbicyclo[2.2.1]hept-2-yl acrylate | 20 wt.-% to 25 wt.-%, |
| 2,4,6-trimethylbenzoyl diphenylphosphine oxide | 10 wt.-% to 25 wt.-%, |
| dipropylene glycol diacrylate | 3 wt.-% to 10 wt.-%. |

In a further step at least one protective varnish is preferably printed on by means of inkjet printing. In particular, the protective varnish is printed onto the decorative ply and/or onto the ink and/or onto the ink layer. The protective varnish forms in particular a part of the decoration.

The protective varnish protects the decoration on an object to be decorated in particular from mechanical and/or chemical stress.

Preferably, a light-curing, in particular a UV-curing, particularly preferably an LED-curing, in particular preferably a UV-LED-curing, protective varnish is printed on.

The protective varnish can be partially cured or precured and/or fully cured by radiation, preferably by UV radiation, in particular by UV-LED radiation. In particular, the partial and/or full cure of the protective varnish is effected analogously to or under the same conditions as in the case of the primer described in the present case.

The layer thickness of the protective varnish preferably lies between 0.5 μm and 10 μm, in particular between 0.5 μm and 5 μm.

Protective varnishes which have the following composition have proved to be advantageous:

| | |
|---|---|
| 2-phenoxyethyl acrylate | 25 wt.-% to 50 wt.-%, |
| 4-(1-oxo-2-propenyl)morpholine | 10 wt.-% to 25 wt.-%, |
| exo-1,7,7-trimethylbicyclo[2.2.1]hept-2-yl acrylate | 20 wt.-% to 25 wt.-%, |
| 2,4,6-trimethylbenzoyl diphenylphosphine oxide | 10 wt.-% to 25 wt.-%, |
| dipropylene glycol diacrylate | 3 wt.-% to 10 wt.-%. |

It is expedient if the ink and/or the ink layer and the protective varnish are fully cured together. In addition to the full cure of the ink and/or the ink layer and the protective varnish together, the full cure of the primer is advantageously effected. Ideally, a full cure is effected when all the layers which ultimately form the decoration, in particular the decorative ply, the ink/link layer and/or the protective varnish, have been applied to and/or printed onto the transfer paper. If one of the layers to be cured within the layer composite to be cured is not sufficiently permeable to the radiation which is needed for the curing, it is advantageous to irradiate with the radiation needed for the curing from two opposite sides of the transfer paper. In principle, however, it is also possible for the individual layers of the decoration or of the decal to be cured separately in each case.

The production of the decal and/or of the decoration is advantageously effected in an inline manufacture, in particular in an assembly line manufacture. By inline manufacture is meant in the present case in particular a continuous manufacture. This means that the decals are produced substantially without interruption, in particular in a continuous process. If a method step for producing the decal has been effected, then the subsequent method step essentially follows straightaway. The individual steps of the method transition into each other almost seamlessly. In particular, no intermediate storage and/or a rolling-up or stacking of the decal and/or of the decoration is effected during an inline manufacture.

A carrier is expediently applied in a further step. The carrier ensures in particular a better handling of the decoration and/or of the decal during the further processing. The carrier is preferably applied to the decoration. In particular, the carrier is applied to an outermost side of the decoration. By outermost side of the decoration is meant in particular a free side of the decoration which faces away from the object when the decoration is applied to the object. The carrier is hereby arranged on a side of the decoration facing away from the transfer paper.

Because the carrier is applied to the decal in particular as a final layer, the carrier also serves to protect the decoration from damage. The carrier can be applied to the decorative ply, to the ink and/or to the protective varnish. The carrier can cover the entire surface of the decal or alternatively cover only the areas of surface of the decal to which the decoration is applied.

The carrier preferably has a layer thickness of between 10 μm and 500 μm, preferably a layer thickness of between 10 μm and 200 μm, particularly preferably a layer thickness of between 20 μm and 30 μm. An acrylate film, in particular a self-crosslinking acrylate film, is preferably used as carrier. The carrier can be formed self-supporting.

The application of the carrier is advantageously effected by means of printing. This can be effected either in screen printing or preferably by means of inkjet printing.

It is advantageous if the application or the printing of the carrier is effected substantially immediately after the manufacture of the decoration. The application of the carrier is thus preferably effected in particular as an integral constituent of the production of the decal. The application of the carrier is advantageously effected in inline manufacture.

To print the layers on, in particular the primer, the ink, the ink layer, the protective varnish and/or the carrier, at least one inkjet printhead is preferably used. At least one separate inkjet printhead is preferably used for each layer to be printed.

The inkjet printhead can in particular have a resolution of from 300 to 1200 nozzles per inch (npi). A high-resolution application of the layers is hereby made possible. The inkjet printhead can have a nozzle diameter of from 15 μm to 25 μm with a tolerance of not more than ±5 μm and/or a nozzle spacing of from 30 μm to 150 μm, in particular a nozzle spacing of from 30 μm to 80 μm, with a tolerance of not more than ±5 μm. The small nozzle spacing, in particular transverse to the printing direction, ensures that the transferred droplets of the layers to be printed lie sufficiently close to each other or optionally even overlap, with the result that a good resolution is achieved over the entire printed-on surface.

The inkjet printhead can be formed such that droplets of the layers to be printed are provided at a frequency of from 6 kHz to 110 kHz. At usual conveying speeds of the transfer paper to be printed on of from 10 m/min to 30 m/min a resolution of from 360 dpi to 1200 dpi can thus be achieved in the conveying direction. It is expedient if droplets of the layers to be printed are provided by the inkjet printhead with a volume of from 2 pl to 50 pl with a tolerance of not more than ±6%. The necessary quantity of the layers to be printed can hereby be applied uniformly.

Furthermore, the inkjet printhead is formed such that droplets of the layers to be printed are provided at a flight speed of from 5 m/s to 10 m/s with a tolerance of not more than ±15%. The deflection of the droplets, in particular by drafts of air, is hereby minimized during the transfer from the printhead to the transfer paper and/or to the decorative ply, with the result that the droplets land on the transfer paper and/or on the decorative ply in the desired defined arrangement.

The device for producing a decal preferably has at least a second inkjet printhead for printing an ink and/or an ink layer onto the stamping film and/or onto the decorative ply. The second inkjet printhead is in particular arranged downstream of the stamping station in the conveying direction of the transfer paper.

It is expedient if the device has at least a third inkjet printhead for printing a protective varnish onto the decorative ply and/or onto the ink. The third inkjet printhead is in particular arranged downstream of the second inkjet printhead in the conveying direction of the transfer paper.

The individual layers of the decoration can be applied to the transfer paper inline due to the arrangement of the inkjet printheads in the conveying direction of the transfer paper one behind another or in a row.

The device preferably has at least one curing apparatus for precuring and/or fully curing the primer, the ink and/or the ink layer and/or the protective varnish. A UV light source, in particular a (UV-)LED light source can be used as curing apparatus.

In principle, a curing apparatus can be arranged behind, in the conveying direction of the transfer paper, every inkjet printhead which prints a light-curing, in particular UV-curing, ink or UV-curing substance. It is hereby achieved that after the ink or the substance has exited the printer it can be immediately at least precured or else also fully cured.

The device preferably has a curing apparatus between the first inkjet printhead and the stamping station. The curing apparatus serves in particular to precure the primer, with the result that it partially gelatinizes and a squeezing together of the image and/or motif generated by the printed-on primer is reduced and/or prevented.

It is advantageous if a curing apparatus, preferably exclusively a curing apparatus, is arranged downstream, in the conveying direction of the transfer paper, of the hindmost inkjet printhead which prints a light-curing, in particular UV-curing, ink. All layers can hereby be fully cured in only a single process or in only a single method step. If a second inkjet printhead is present, a curing apparatus can be arranged downstream of the second inkjet printhead in the conveying direction of the transfer paper. If, in addition to the second inkjet printhead, the device also has a third inkjet printhead, then a curing apparatus is preferably arranged downstream of the third inkjet printhead in the conveying direction of the transfer paper. A curing apparatus which is arranged behind the second inkjet printhead but in front of the third inkjet printhead in the conveying direction of the transfer paper can then in particular be dispensed with.

The device can have a drying apparatus for drying the primer. The drying apparatus is preferably arranged behind the first inkjet printhead and in front of the stamping station in the conveying direction of the transfer paper.

It is expedient if the device has an apparatus for applying a carrier to the decoration. The apparatus is preferably arranged downstream of the stamping station, of the second inkjet printhead or after the third inkjet printhead in the conveying direction of the transfer paper. Ideally, the apparatus is preferably downstream, in the conveying direction of the transfer paper, after the stamping station or the inkjet printhead which produces an outermost layer and/or the outermost side of the decoration. It is hereby achieved that the carrier forms the final layer of the decal. The carrier thus protects the decoration from damage.

It is advantageous if the apparatus for applying the carrier is formed as at least a fourth inkjet printhead.

It is expedient if the object provided with the decoration is cured. The adhesion of the decoration or the adhesion between basecoat and primer and/or the resistance of the decoration for example to water, alcohol, wear and/or fingernails can be improved hereby. The decorated object is preferably cured in a time interval of between 10 minutes and 30 minutes and/or at a temperature of between 165° C. and 200° C. The decoration should in particular be formed such that it is resistant to fingernail scratches after being dipped in 52% alcohol for 30 minutes and/or dipped in water for 60 minutes.

The decoration is preferably transferred onto the object by means of pad printing. It is hereby possible to integrate the decoration of the object and the production of the decoration inline or in an inline manufacture, in particular in an assembly line manufacture. In particular, a substantially completely automated method for decorating objects can thus be created. In principle, however, it is also conceivable to transfer the decoration onto the object manually.

Further, it is possible for the detachment of the decal from the transfer paper to be effected preferably by bringing the decal on the transfer paper into contact, or contacting it, with an, in particular heated, pad instead of by soaking the transfer paper, in particular the water transfer paper, in water.

Here, the transfer paper preferably comprises a hot-melt coating, which has in particular a melting range of between 50° C. and 150° C., preferably between 80° C. and 120° C. For this, the hot-melt coating of the transfer paper can have, for example, predominantly constituents made of a wax and/or made of a thermoplastic polymer. Such a transfer paper, which has a hot-melt coating, is in particular a heat transfer paper.

The adhesive force of the hot-melt coating is advantageously reduced when the hot-melt coating is heated to a temperature within the melting range in such a way that the transfer paper, in particular the heat transfer paper, can be peeled off or separated from the decal, in particular from the decoration.

Further, it is advantageous if the pad is heated actively and/or passively in particular before and/or during the transfer. The temperature range of the heated pad here advantageously lies between 70° C. and 150° C., preferably between 120° C. and 140° C. It is hereby possible for the hot-melt coating of the transfer paper, in particular of the to heat transfer paper, to soften when the pad is brought into contact or contacted with the decal and for a transfer of the decal, in particular of the decoration, onto the pad to be effected. The transfer paper, in particular the heat transfer paper, is then advantageously removed from the decoration. The transfer of the decal, in particular of the decoration, onto the object and a possible further processing is preferably effected as described above or analogously to the design of the transfer paper as a water transfer paper.

The decoration can be arranged on the object in register with other features of the object, for example its outer edges, inner and/or outer contours of the object, other decorative elements, colorings, functional elements and the like. If the object is fixed in a parts receiver for example during the application of the decoration, the decoration on the object can also be arranged in register with features on and/or against the parts receiver. It is thus possible to insert the decoration into an existing overall design and/or an overall function of the object.

The decal, the decoration of which is transferred onto an object, is advantageously produced by means of a method according to the invention.

If the decal has a carrier, then it is advantageous if the carrier is removed from the decoration after the decoration has been applied to the object. The carrier can, however, also remain on the object for example for an even longer time during the transport and/or during the storage of the object.

BRIEF DESCRIPTION OF THE DRAWINGS

The invention is explained by way of example in the following with reference to several embodiment examples with the aid of the attached figures. There are shown in.

DETAILED DESCRIPTION OF THE PREFERRED EMBODIMENTS

Figure 1:
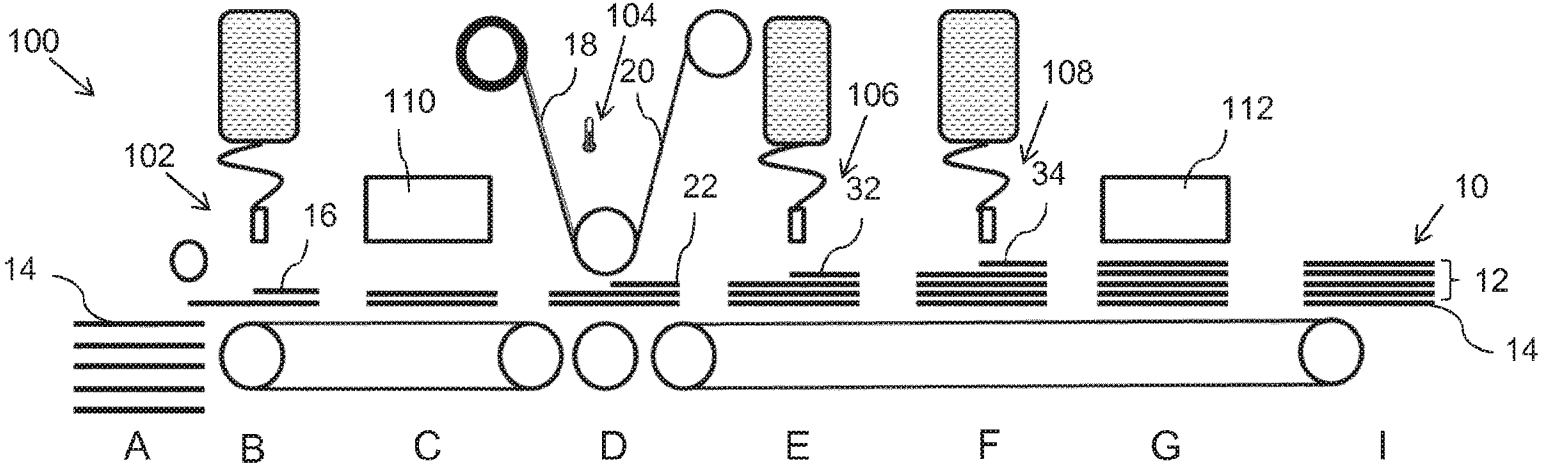
FIG. 1 a schematic representation of a method as well as a device in a design for producing a decal in one embodiment, FIG. 2 a schematic representation of a further method as well as a device in a further design for producing a decal in a further embodiment, FIG. 3 a schematic representation of a further method as well as a device in a further design for producing a decal in a further embodiment, FIG. 4 a schematic representation of a stamping film in one embodiment, FIG. 5 a schematic representation of a method for decorating surfaces of objects, FIG. 6 a schematic representation of a further method for decorating surfaces of objects.

FIG. 1 shows a schematic representation of a method as well as a device 100 in a design for producing a decal 10 in one embodiment.

The provision of a transfer paper 14 is effected in a method step A. In a method step B a primer 16 is then printed, by means of inkjet printing, onto the transfer paper 14 and/or onto a stamping film 18 having a decorative ply 22 and a carrier ply 20. The printed-on primer 16 defines in particular the surface area or the surface areas for the stamping film transfer or for the later decoration 12. The device 100 preferably has at least a first inkjet printhead 102 for printing the primer 16 on.

The transfer paper 14 is preferably a water transfer paper and/or a heat transfer paper.

In particular, the primer 16 has only a very small number of solid constituents, such as particulate material and/or particles, which should not exceed a particular size, in particular a size of between 2 μm and 10 μm. It is hereby ensured that the nozzles of an inkjet printhead 102 do not clog. The primer 16 is preferably not pigmented. The primer 16 has in particular no fillers at all.

The primer 16 is advantageously printed on with an area density of from 0.5 $g/m^2$ to 20 $g/m^2$. The printed-on primer 16 preferably has a layer thickness of from 0.05 μm to 10 μm, in particular a layer thickness of from 1 μm to 5 μm. Within this area, which guarantees a particularly good adhesion, the applied quantity and/or the layer thickness of the primer 16 can be varied in order to further optimize the application result.

It is furthermore preferred if the primer 16 is printed on at an application temperature of from 20° C. to 75° C., preferably of from 40° C. to 60° C., and/or with a viscosity in the range of from 5 mPas to 100 mPas, preferably of from 10 mPas to 15 mPas.

Primers 16 which have the following composition have proved to be advantageous:

| | |
|---|---|
| 4-(1-oxo-2-propenyl)morpholine | 29 wt.-% to 50 wt.-%, |
| exo-1,7,7-trimethylbicyclo[2.2.1]hept-2-yl acrylate | 25 wt.-% to 50 wt.-%, |
| 2-phenoxyethyl acrylate | 25 wt.-% to 50 wt.-%, |
| dipropylene glycol diacrylate | 3 wt.-% to 10 wt.-%, |
| 2,4,6-trimethylbenzoyl diphenylphosphine oxide | 3 wt.-% to 10 wt.-%. |

The primer 16 is preferably a light-curing, in particular UV-curing, primer 16. The primer 16 can be precured or partially cured and/or fully cured in a method step C. For this, the device 100 preferably has a curing apparatus 110. The curing apparatus 110 preferably has at least one UV-LED light source.

The application quality of the primer 16 can be improved by a precure. In particular, the viscosity of the primer 16 is hereby increased before the stamping film 18 is applied. This prevents the applied primer pixels from running or squeezing together too much during the transfer, with the result that a particularly sharp-edged application of the stamping film 18 and a particularly high surface quality of the transferred layers are achieved. However, a slight squeezing together of the primer pixels can also be quite desirable in order to bring directly adjacent primer pixels closer to each other and combine them. This is advantageous in particular in order, for example in the case of closed surface areas and/or at motif edges, to avoid a pixelation of the representation, i.e. to prevent individual pixels from appearing in an optically disruptive manner. The squeezing together should be effected only to the extent that the desired resolution is not reduced too much.

To prevent a squeezing together of an image and/or motif generated by the printed-on primer 16, the procure of the primer 16, preferably with a low UV radiation power, is advantageous. The primer 16 is in particular partially gelatinized hereby.

The precure of the primer 16 is preferably effected 0.02 s to 0.025 s after the primer 16 has been printed on. The primer 16 is hereby fixed on the transfer paper 14 very quickly after the printing due to the precure, with the result that the primer droplets are largely prevented from running or spreading and a high print resolution is preserved as well as possible. For this, for example, a radiation source can be arranged directly adjacent to the printhead 102 for printing the primer 16 on.

It is expedient here if the precure of the primer 16 is effected by UV radiation, of which preferably at least 90% of the energy is emitted in the wavelength range between 380 nm and 420 nm. At these wavelengths the precure is reliably started.

It is further advantageous if the precure of the primer 16 is effected with a gross irradiance of from 2 W/cm$^2$ to 5 W/cm$^2$ and/or a net irradiance of from 0.7 W/cm$^2$ to 2 W/cm$^2$ and/or an energy input into the primer 16 of from 8 mJ/cm$^2$ to 112 mJ/cm$^2$. It is hereby achieved that the primer 16 undergoes the desired viscosity increase, but while not being completely fully cured, with the result that the necessary adhesive effect of the primer 16 is preserved when the stamping film 18 is applied.

The precure of the primer 16 is preferably effected with an exposure time of from 0.02 s to 0.056 s. The necessary energy input for the precure is thus ensured at the mentioned transport speeds of the transfer paper 14 and at the specified irradiances.

It is expedient if, during the precure of the primer 16, its viscosity increases to 50 mPas to 200 mPas. Such a viscosity increase guarantees that the primer droplets are not squeezed together during the application of the stamping film 18 to the transfer paper 14, with the result that the stamping film 18 can be transferred to the transfer paper 14 substantially with the resolution achieved during the printing of the primer 16.

In addition to the precure or partial cure of the primer 16, a full cure of the primer 16 can also take place at a later time. In principle, however, it is also possible to dispense with a precure of the primer 16. Simply only a full cure of the primer 16 can then take place.

The full cure of the primer 16 is preferably effected after the application of a stamping film 18 or further layers. It is expedient if the full cure of the primer 16 is effected with UV light, of which preferably at least 90% of the energy is emitted in the wavelength range between 380 nm and 420 nm. At these wavelengths the full cure is reliably started.

Furthermore, it is preferred if the full cure of the primer 16 is effected with a gross irradiance of from 12 W/cm$^2$ to 20 W/cm$^2$ and/or a net irradiance of from 4.8 W/cm$^2$ to 8 W/cm$^2$ and/or an energy input into the primer of from 200 mJ/cm$^2$ to 900 mJ/cm$^2$, preferably of from 200 mJ/cm$^2$ to 400 mJ/cm$^2$. A reliable through cure of the primer 16 is achieved with such an energy input.

Furthermore, it is advantageous if the full cure of the primer 16 is effected with an exposure time of from 0.04 s to 0.112 s. The necessary net energy input for the through cure of the primer 16 is thus ensured at the specified gross irradiances and at the usual transport speeds.

It is advantageous if the full cure of the primer 16 takes place together with the full cure of further layers which have additionally also been printed onto or applied to the transfer paper 14. The entire decoration 12 can hereby be fully cured in particular in only one step, which makes the method very efficient.

In FIG. 1 an application, at least in areas, of the stamping film 18 to the transfer paper 14 is effected in a method step D. In FIG. 1 the application is effected by means of hot stamping in a roll-on method. The stamping film 18 is applied to the transfer paper 14 in particular under pressure and temperature. The hot stamping is preferably effected by means of a stamping station 104, which preferably has at least one stamping roller and/or a stamping wheel. After the stamping of the stamping film 18, the carrier ply 20 is preferably peeled off the decorative ply 22 and only at least a part of the decorative ply 22 remains on the transfer paper 14.

In a method step E at least one ink and/or at least one ink layer 32 is printed on by means of inkjet printing. The ink and/or the ink layer 32 here is/are in particular printed onto the decorative ply 22. The ink and/or the ink layer 32 form/forms in particular a part of the decoration 12 and thus influences/influence the visual appearance of the decoration 12. The device 100 preferably has at least a second inkjet printhead 106 for printing the ink and/or the ink layer 32 on.

A light-curing, in particular a UV-curing, particularly preferably an LED-curing, in particular preferably a UV-LED-curing, ink and/or ink layer 32 is/are preferably printed on. In particular, the ink and/or the ink layer 32 can be applied in register with a feature of the stamping film 18. The feature can be a register mark and/or a motif on the stamping film 18.

The ink and/or the ink layer 32 can be partially cured or precured and/or fully cured by radiation, preferably by UV radiation, in particular by UV-LED radiation. In particular, the ink or the ink layer 32 is fully cured and/or precured analogously to the primer 16.

The layer thickness of the ink and/or the ink layer 32 preferably lies between 0.5 μm and 10 μm, in particular between 0.5 μm and 5 μm. Inks and/or ink layers 32 which have the following composition have proved to be advantageous:

| | |
|---|---|
| 2-phenoxyethyl acrylate | 25 wt.-% to 50 wt.-%, |
| 4-(1-oxo-2-propenyl)morpholine | 10 wt.-% to 25 wt.-%, |
| exo-1,7,7-trimethylbicyclo[2.2.1]hept-2-yl acrylate | 20 wt.-% to 25 wt.-%, |
| 2,4,6-trimethylbenzoyl diphenylphosphine oxide | 10 wt.-% to 25 wt.-%, |
| dipropylene glycol diacrylate | 3 wt.-% to 10 wt.-%. |

In a method step F at least one protective varnish 34 is printed on by means of inkjet printing. In particular, the protective varnish 34 is printed onto the ink and/or onto the ink layer 32. The protective varnish 34 forms in particular a part of the decoration 12 and protects the decoration 12 on an object 50 to be decorated in particular from mechanical and/or chemical stress. The device 100 preferably has at least a third inkjet printhead 108 for printing the protective varnish 34 on.

Preferably, a light-curing, in particular a UV-curing, particularly preferably an LED-curing, in particular preferably a UV-LED-curing, protective varnish 34 is printed on. The protective varnish 34 can be partially cured or precured and/or fully cured by radiation, preferably by UV radiation, in particular by UV-LED radiation. In particular, the protective varnish 34 is fully cured and/or procured analogously to the primer 16.

The layer thickness of the protective varnish 34 preferably lies between 0.5 μm and 10 μm, in particular between 0.5 μm and 5 μm. Protective varnishes 34 which have the following composition have proved to be advantageous:

| | |
|---|---|
| 2-phenoxyethyl acrylate | 25 wt.-% to 50 wt.-%, |
| 4-(1-oxo-2-propenyl)morpholine | 10 wt.-% to 25 wt.-%, |
| exo-1,7,7-trimethylbicyclo[2.2.1]hept-2-yl acrylate | 20 wt.-% to 25 wt.-%, |
| 2,4,6-trimethylbenzoyl diphenylphosphine oxide | 10 wt.-% to 25 wt.-%, |
| dipropylene glycol diacrylate | 3 wt.-% to 10 wt.-%. |

In a method step G the ink and/or the ink layer 32 and the protective varnish 34 are preferably fully cured together. For the full cure, the device 100 preferably has a curing apparatus 112. The curing apparatus 112 is preferably formed as a UV-LED light source.

In addition to the full cure of the ink and/or the ink layer 32 and the protective varnish 34 together, the full cure of the primer 16 is advantageously also effected. Ideally, a full cure is effected when all the layers 16, 22, 32, 34 which ultimately form the decoration 12 have been applied to and/or printed onto the transfer paper 14.

The production of the decal 10 is advantageously effected in an inline manufacture, in particular in an assembly line manufacture. The decal 10 is preferably produced here substantially without interruption, in particular in a continuous process. If a method step for producing the decal 10 has been effected, then the subsequent method step essentially follows straightaway. The individual steps of the method transition into each other almost seamlessly.

The finished decal 10 is represented in a method step I. The decal 10 comprises the transfer paper 14 and the decoration 12 which can be separated from the transfer paper 14. The decoration 12 preferably comprises the primer 16 printed by means of inkjet printing, the decorative ply 22 of the stamping film 18, in particular comprising a metallic layer 28, and the ink and/or ink layer 32 printed by means of inkjet printing and the protective varnish 34 printed by means of inkjet printing.

To print the layers, in particular the primer 16, the ink, the ink layer 32, the protective varnish 34 and/or a carrier 36 on, at least one inkjet printhead 102, 106, 108, 116 is preferably used. At least one separate inkjet printhead 102, 106, 108, 116 is preferably used for each layer 16, 32, 34, 36 to be printed.

The inkjet printhead 102, 106, 108, 116 can in particular have a resolution of from 300 to 1200 nozzles per inch (npi). A high-resolution application of the layers 16, 32, 34, 36 is hereby made possible. The inkjet printhead 102, 106, 108, 116 can have a nozzle diameter of from 15 μm to 25 μm with a tolerance of not more than ±5 μm and/or a nozzle spacing of from 30 μm to 150 μm, in particular a nozzle spacing of from 30 μm to 80 μm, with a tolerance of not more than ±5 μm. The small nozzle spacing, in particular transverse to the printing direction, ensures that the transferred droplets of the layers 16, 32, 34, 36 to be printed lie sufficiently close to each other or optionally even overlap, with the result that a good resolution is achieved over the entire printed-on surface.

The inkjet printhead 102, 106, 108, 116 can be formed such that droplets of the layers 16, 32, 34, 38 to be printed are provided at a frequency of from 6 kHz to 110 kHz. At usual conveying speeds of the transfer paper 14 to be printed on, of from 10 m/min to 30 m/min, a resolution of from 360 dpi to 1200 dpi can thus be achieved in the conveying direction. It is expedient if droplets of the layers 16, 32, 34, 36 to be printed are provided by the inkjet printhead 102, 106, 108, 116 with a volume of from 2 pl to 50 pl with a tolerance of not more than ±6%. The necessary quantity of the layers 16, 32, 34, 36 to be printed can hereby be applied uniformly.

Furthermore, the inkjet printhead 102, 106, 108, 116 is formed such that droplets of the layers 16, 32, 34, 36 to be printed are provided at a flight speed of from 5 m/s to 10 m/s with a tolerance of not more than ±15%. The deflection of the droplets, in particular by drafts of air, is hereby minimized during the transfer from the printhead 102, 106, 108, 116 to the transfer paper 14 and/or to the decorative ply 22, with the result that the droplets land on the transfer paper 14 and/or on the decorative ply 22 in the desired defined arrangement.

Figure 2:
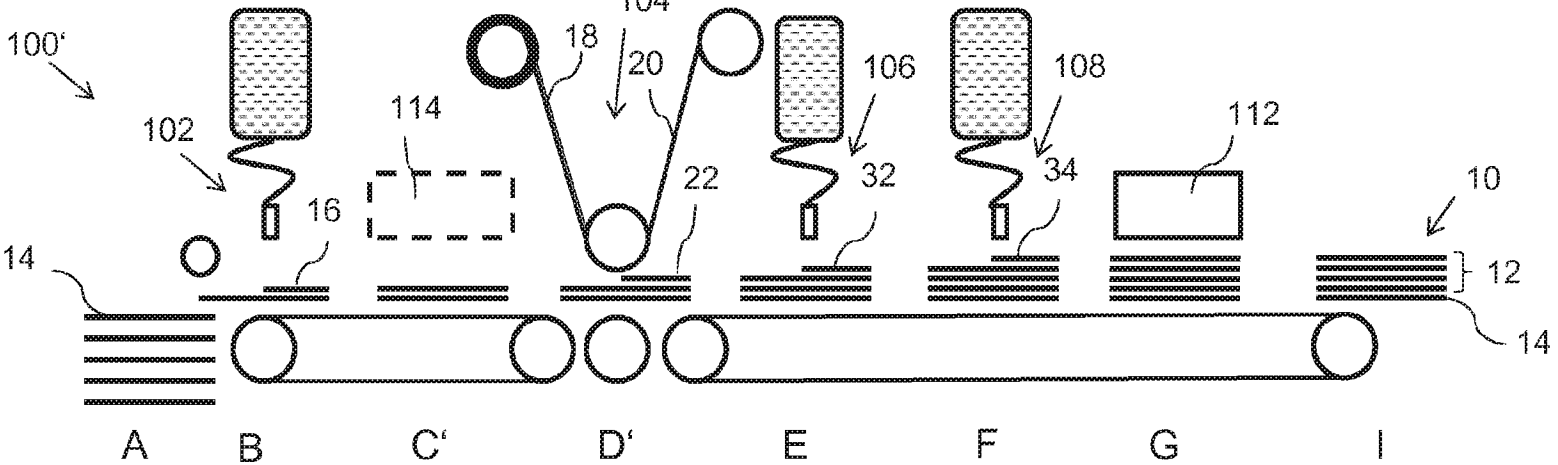

FIG. 2 shows a schematic representation of a further method as well as a device 100' in a further design for producing a decal 10 in a further embodiment. The method shown in FIG. 2 differs from the method shown in FIG. 1 substantially in that it is a cold stamping method instead of a hot stamping method and the primer 16 is dried in a method step C'. To dry or partially dry the primer 16, the device 100' has a drying apparatus 114. The duration of the partial drying and/or of the drying preferably lies between 1 s and 60 s and/or the drying temperature preferably lies between 40° C. and 120° C. In principle, however, it is possible that the drying apparatus 114 and thus the method step C' can be dispensed with. Relating to the other method steps A and B as well as E to I, reference is made to the statements made regarding FIG. 1.

Figure 3:
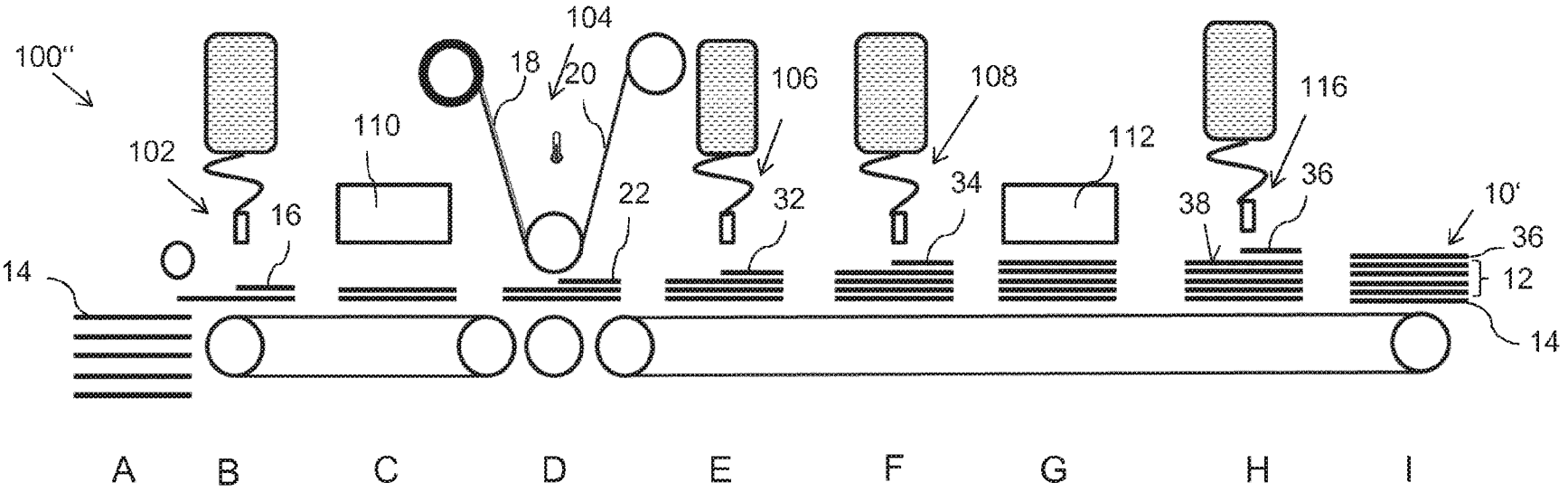

FIG. 3 shows a schematic representation of a further method as well as a device 100" in a further design for producing a decal 10' in a further embodiment.

In FIG. 3 the stamping film 18—as already represented in FIG. 1—is applied by means of hot stamping. Relating to the method steps A to G as well as I and the corresponding device apparatuses 102, 110, 104, 106, 108 and 112, reference is therefore made to the statements made regarding FIG. 1. In principle, however, it is also possible for the stamping film 18 in FIG. 3 to be applied by means of cold stamping instead of by means of hot stamping.

The device 100" represented in FIG. 3 has an apparatus 116 for applying a carrier 36 to the decoration 12. The apparatus 116 is arranged downstream of the second curing apparatus 112 in the conveying direction of the transfer paper 14. Ideally, the apparatus 116 is at least preferably downstream, in the conveying direction of the transfer paper 14, after the inkjet printhead 108 that produces an outermost layer 38 and/or an outermost side of the decoration 12. It is hereby achieved that the carrier 36 forms the final layer of the decal 10'. The carrier 36 thus protects the decoration 12 from damage. The carrier 36 furthermore ensures a better handling of the decoration 12 and/or of the decal 10' during the further processing. The apparatus for applying the carrier 36 is advantageously formed as at least a fourth inkjet printhead 116.

It is advantageous if the application or the printing of the carrier 36 is effected substantially immediately after the manufacture of the decoration 12. The application of the carrier 36 is advantageously effected in inline manufacture.

The carrier 36 preferably has a layer thickness of between 10 μm and 500 μm, preferably a layer thickness of between 10 μm and 200 μm, particularly preferably a layer thickness of between 20 μm and 30 μm. An acrylate film, in particular a self-crosslinking acrylate film, is preferably used as carrier 36.

Figure 4:
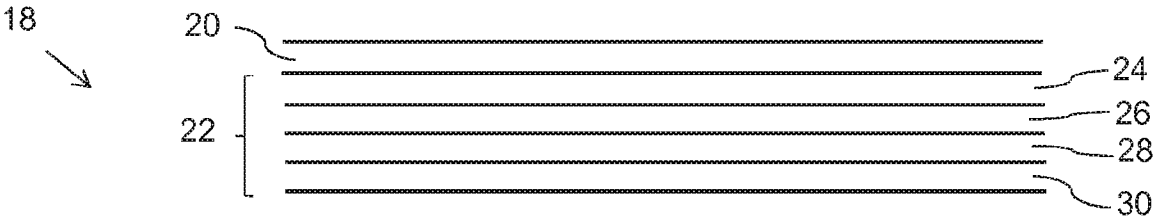

FIG. 4 shows a schematic representation of a stamping film 18 in one embodiment. The stamping film 18 has a carrier ply 20 and a decorative ply 22, wherein the decorative ply 22 of the stamping film 18 can be formed single- or multi-layered.

The carrier ply 20 of the stamping film 18 is preferably formed from PET, PC, PP, PE, PVE and/or PS. The carrier ply 20 protects and stabilizes the decorative ply 22 in particular during the production, storage and processing of the stamping film 18.

The decorative ply 22 is in particular detachable from the carrier ply 20. In order to be able to ensure a reliable detachment between carrier ply 20 and decorative ply 22, the stamping film 18 can preferably have a detachment layer 24 between the carrier ply 20 and the decorative ply 22. The detachment layer 24 is preferably formed such that it on the one hand guarantees a safe handling of the stamping film 18, without the decorative ply 22 separating from the carrier ply 20 before the stamping film 18 is applied to the transfer paper 14, but on the other hand makes it possible to detach, at least in areas, the decorative ply 22 from the carrier ply 20 after the stamping film 18 has been applied or when the decorative ply 22 is transferred onto the transfer paper 14.

The detachment layer 24 preferably has a layer thickness of from 0.001 μm to 1 μm, in particular a layer thickness of from 0.001 μm to 0.1 μm, particularly preferably a layer thickness of approx. 0.01 μm. The detachment layer 24 can comprise waxes and/or silicones. It is advantageously a polymeric detachment layer 24. The detachment layer 24 is particularly preferably free of wax and/or free of silicone. A layer which can be overprinted very well, in particular with conventional printing inks, with UV-curing printing inks, UV-curing varnishes, hybrid inks and/or hybrid varnishes, is hereby obtained. A good adhesion between decorative ply and print and/or printing inks can also be achieved in this way.

The detachment layer 24 advantageously comprises hydroxypropyl methylcellulose, in particular 90 wt.-% to approx. 100 wt.-% hydroxypropyl methylcellulose.

Furthermore, the decorative ply 22 represented in FIG. 4 preferably has at least one metallic layer 28. The metallic layer 28 ensures in particular the visual appearance of the decorative ply 22 and/or of the decoration 12. The metallic layer 28 is preferably formed from aluminum. However, it is also possible for the metallic layer 28 to be formed from copper, chromium and/or tin or to comprise an alloy thereof. The metallic layer 28 preferably has a layer thickness of from 5 nm to 100 nm, in particular a layer thickness of from 5 nm to 50 nm, particularly preferably a layer thickness of from 15 nm to 25 nm. The metallic layer 28 is preferably vapor-deposited by means of known PVD or CVD methods (PVD=Physical Vapor Deposition; CVD=Chemical Vapor Deposition). The metallic layer 28, in particular consisting of inks fine with metallic pigments, can additionally or alternatively also be printed on. The metallic layer 28 can be over the whole surface or be present only partially. A partial metallic layer can be structured in particular by means of known demetallization methods such as etching, washing methods or photolithographic methods.

In principle, however, it is also conceivable for the decorative ply 22 to have an ink layer. The ink layer is preferably printed on by means of gravure printing, screen printing, flexographic printing, inkjet printing, and has a layer thickness of from 0.2 μm to 10 μm, in particular a layer thickness of from 0.5 μm to 3 μm. The ink layer can be present over the whole surface and/or partially. The ink layer can be opaque or translucent or transparent and in every case can be colorless or colored. The chromaticity can be achieved by means of dyes and/or pigments in the ink layer. For example, the ink layer consists of polyacrylates.

It is in particular also possible for the decorative ply 22 to have an ink layer and a metallic layer 28, wherein the layers are preferably to be provided in each case partially and the partially provided areas are to be arranged in register with each other. For example, the metallic layer 28 and/or the ink layer, individually or together, represent/represents a motif or in each case a motif or partial motif.

The decorative ply 22 can in addition have a basecoat 30. The basecoat 30 ensures in particular a good adhesion between the decorative ply 22 or the stamping film 18 and the primer 16. The basecoat 30 preferably has a layer thickness of from 0.2 μm to 10 μm, in particular a layer thickness of from 0.5 μm to 3 μm, particularly preferably a layer thickness of from 0.4 μm to 0.6 μm.

Basecoats 30 which have the following composition have proved to be advantageous:

| | |
|---|---|
| polyvinyl butyral | 25 wt.-% to 50 wt.-%, |
| styrene maleic anhydride | 50 wt.-% to 75 wt.-%. |

The decorative ply 22 can furthermore preferably comprise at least one varnish layer 26, in particular a protective varnish layer. The protective varnish layer 26 represents in particular a protection from mechanical and/or chemical stress for the decorative ply 22 and/or the decoration 12 on an object 60 to be decorated.

The varnish layer and/or protective varnish layer 26 preferably has/have a layer thickness of from 0.4 μm to 10 μm, in particular a layer thickness of from 0.5 μm to 5 μm, in particular preferably a layer thickness of from 1 μm to 1.5 μm. The varnish layer and/or the protective varnish layer 26 advantageously has/have an isocyanate crosslinking. In particular, higher scratch, wear and chemical resistances can be achieved hereby. If the varnish layer or the protective varnish layer 26 contains dyes, the layer 26 can influence the optical impression of the decorative ply 22 and/or of the decoration 12.

Varnish and/or protective varnish layers 26 which have the following composition have proved to be advantageous:

| | |
|---|---|
| acrylate polyol | 36 wt.-% to 56 wt.-%, |
| polyvinyl butyral | 9 wt.-% to 14 wt.-%, |
| diisocyanate | 30 wt.-% to 40 wt.-%, |
| dyes | 0 wt.-% to 25 wt.-%. |

At least the varnish layers and/or the protective varnish layers 26 and/or the basecoat 30, in particular all of these layers, are advantageously provided with polymers containing hydroxyl groups. The layers hereby obtain a sufficiently high tensile strength, with the result that the decorative ply 22 or the decoration 12 applied to the object 60 to be decorated does not experience any cracking and/or blistering during a tempering in a furnace.

Figure 5:
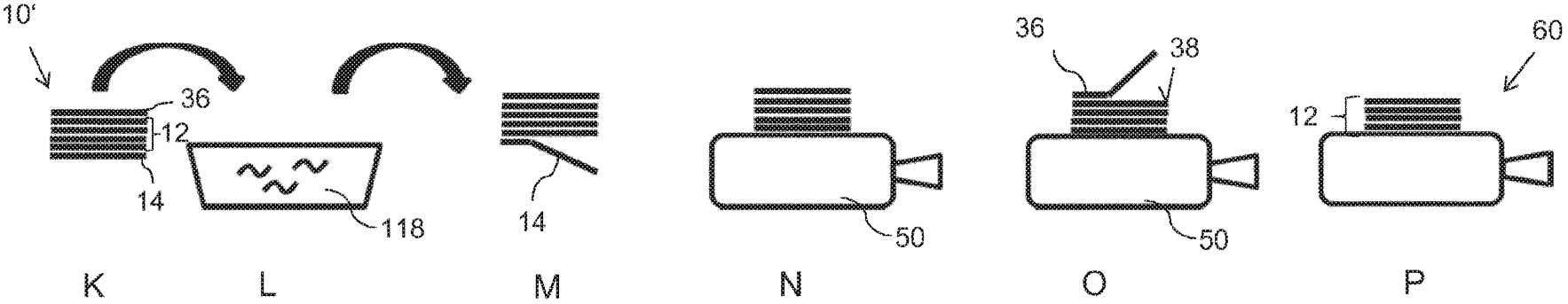

FIG. 5 shows a schematic representation of a method for decorating surfaces of objects 50 by means of the method steps K to P.

The surfaces of the objects 50 are in principle not set to a specific shape. The surfaces can be shaped cylindrical, wavy, pyramidal, conical, curved, concave and/or to convex. They can also be formed angular, in particular rectangular or generally polygonal, oval, round and/or flat.

The objects 50 can be objects 50 made of glass, ceramic, porcelain, plastic, wood and/or paper and/or metal and/or composites of several different materials, for example plastic/glass, plastic/metal, plastic/wood, plastic/paper. It can be advantageous to pretreat the surface of the objects 50, for example by means of plasma or corona treatment and/or by means of precoating with adhesion-promoter layer, for example with one or more polymeric adhesion-promoter layers.

The provision of the decal 10' is effected in a method step K. The decal 10' is preferably produced by means of a method according to the invention. In principle, the provision of a decal 10 without a carrier 36 is also conceivable. The decal 10' is soaked in a method step L. The decal 10' is preferably dipped in water 118. Due to the soaking of the decal 10' a water-soluble layer of the transfer paper 14 dissolves and the transfer paper 14 can be removed from the decoration 12 along with the carrier 36. Because of the water-soluble layer of the transfer paper 14, the transfer paper 14 shown in FIG. 5 is a water transfer paper. This is represented in a method step M in FIG. 5. In a method step N the decoration 12 is now applied to the object 50 along with the carrier 36. Next, the detachment of the carrier 36 from the decoration 12 is then preferably effected. This is represented in a method step O in FIG. 5. The outer side 38 of the decoration is exposed by the removal of the carrier 36. In a method step P the finished decorated object 60 having the decoration 12 is shown. The transfer of the decoration 12 is preferably effected inline with the production of the decal 10, 10'.

It is expedient if the object 50 provided with the decoration 12 is cured. The adhesion of the decoration 12 or the adhesion between the individual layers of decoration 12, in particular between basecoat 30 and primer 16, can be improved hereby. The resistance of the decoration 12 for example to water, alcohol, wear and/or fingernails is in addition also improved. For this, the decorated object 60 is preferably cured in a time interval of between 10 minutes and 30 minutes and/or at a temperature of between 165° C. and 200° C. The decoration 12 should in particular be formed such that it is resistant to fingernail scratches after being dipped in 52% alcohol for 30 minutes and/or dipped in water for 60 minutes.

Figure 6:
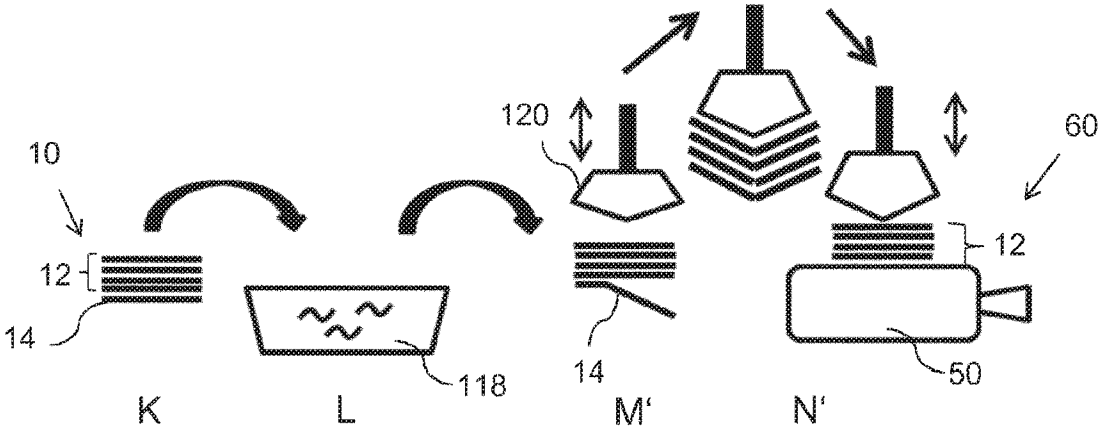

FIG. 6 shows a schematic representation of a further method for decorating surfaces of objects 50.

The provision of the decal 10 is effected in a method step K. After the decal 10 has been soaked preferably in water 118 in a method step L, the transfer paper 14 can be removed from the decoration 12. This happens in a method step M' in FIG. 6. The transfer paper 14 shown in FIG. 6 is a water transfer paper. The decoration 12 is transferred onto the object 50 in a method step N' by means of pad printing, preferably by means of a pad 120. A finished decorated object 60 is thus obtained.

Further, it is also possible for the detachment of the decal 10 from the transfer paper 14 to be effected preferably also by bringing the decal 10 on the transfer paper into contact, or contacting it, with an, in particular heated, pad instead of, as shown in FIG. 5 and FIG. 6, by soaking the transfer paper, in particular the water transfer paper, in water. Here, the transfer paper 14 expediently comprises a hot-melt coating, which has in particular a melting range of between 50° C. and 150° C., preferably between 80° C. and 120° C. For this, the hot-melt coating of the transfer paper 14 can have, for example, predominantly constituents made of a wax and/or made of a thermoplastic polymer. Such a transfer paper 14, which has a hot-melt coating, is a heat transfer paper.

The adhesive force of the hot-melt coating is advantageously reduced when the hot-melt coating is heated to a temperature within the melting range in such a way that the transfer paper 14, in particular the heat transfer paper, can be peeled off or separated from the decal 10, in particular from the decoration 12.

Further, it is advantageous if the pad is heated actively and/or passively in particular before and/or during the transfer. The temperature range of the heated pad here advantageously lies between 70° C. and 150° C., preferably between 120° C. and 140° C. It is hereby possible for the hot-melt coating of the transfer paper 14 to soften when the pad is brought into contact or contacted with the decal 10 and for a transfer of the decal 10, in particular of the decoration 12, onto the pad to be effected.

The transfer paper 14 is then advantageously removed from the decoration 12. The transfer of the decal 10, in particular of the decoration 12, onto the object 50 and a possible further processing is preferably effected as described above or analogously to the design of the transfer paper 14 as a water transfer paper.

The decoration of the object 50 and the production of the decal 10, 10' are preferably integrated inline or in an inline manufacture, in particular in an assembly line manufacture. In particular, a substantially completely automated method for decorating objects 50 can thus be created.

LIST OF REFERENCE NUMBERS

10, 10' decal
12 decoration
14 transfer paper
16 primer
18 stamping film
20 carrier ply
22 decorative ply
24 detachment layer
26 (protective) varnish layer
28 metallic layer
30 basecoat
32 ink/ink layer
34 protective varnish
36 carrier
38 outer side of decoration
50 object
60 decorated object
100, 100', 100" device
102 first inkjet printhead
104, 104' stamping station
106 second inkjet printhead
108 third inkjet printhead

110 first (pre-/full) curing apparatus
112 second (full) curing apparatus
114 drying apparatus
116 apparatus for applying carrier/fourth inkjet printhead
118 water
120 pad
A-P method steps

The invention claimed is:

1. A method for producing a decal with at least one decoration comprising:

providing a water transfer paper, providing a stamping film, the stamping film having a carrier ply and a decorative ply, printing, by means of inkjet printing, a primer onto the transfer paper and/or onto the stamping film, pre-curing the primer, applying, at least in areas, the stamping film to the transfer paper by means of hot or cold stamping, whereby the decorative ply of the stamping film is transferred to the water transfer paper after the pre-curing of the primer, and fully curing the primer and the decorative ply after the transfer of the decorative ply to the water transfer paper.

2. The method according to claim 1, wherein the transfer paper comprises a water-soluble layer.

3. The method according to claim 1, wherein the primer is a light-curing primer, wherein the primer is partially cured and fully cured by radiation.

4. The method according to claim 1, wherein the primer is dried by means of IR radiation.

5. The method according to claim 1, wherein the primer is printed on at an application temperature of from 20° C. to 75° C.

6. The method according to claim 1, wherein the primer has a viscosity in the range of from 5 mPas to 100 mPas.

7. The method according to claim 1, wherein the stamping film is applied in a roll-on method.

8. The method according to claim 1, wherein, in a further step, at least one ink is printed by means of inkjet printing.

9. The method according to claim 8, wherein, in a further step, at least one protective varnish is printed by means of inkjet printing onto the decorative ply or onto the ink.

10. The method according to claim 9, wherein the ink or the protective varnish is fully cured by radiation.

11. The method according to claim 10, wherein the ink and the protective varnish are fully cured together.

12. The method according to claim 1, wherein the production of the decal and/or the decoration is effected in an inline manufacture.

13. The method according to claim 1, wherein a carrier is applied to the decoration in a further step.

* * * * *